US006512192B1

(12) United States Patent
Yee et al.

(10) Patent No.: US 6,512,192 B1
(45) Date of Patent: Jan. 28, 2003

(54) EXHAUST ARC GAS MANIFOLD

(75) Inventors: Edgar Yee, Chapel Hill, NC (US); Andre Joseph M'Sadoques, Southington, CT (US); Lloyd Eugene Wentler, Efland, NC (US); David Edward Thorn, Burlington, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,653

(22) Filed: Oct. 2, 2001

(51) Int. Cl.[7] ..... H01H 33/02
(52) U.S. Cl. ..... 218/157; 335/201; 335/202
(58) Field of Search ..... 335/8–10, 201, 335/202; 218/15, 34, 147, 148, 149, 155–157; 439/810–814; 201/304, 306

(56) References Cited

U.S. PATENT DOCUMENTS 5,241,289 A * 8/1993 Markowski et al. ..... 335/201
6,198,063 B1 * 3/2001 Kramer ..... 218/157

* cited by examiner

*Primary Examiner*—Lincoln Donovan
(74) *Attorney, Agent, or Firm*—Cantor Colburn LLP

(57) ABSTRACT

A circuit breaker fitted with an exhaust arc gas manifold arranged over ventilation slots of the circuit breaker and disposed at a line end thereof to redirect the arc exhaust gases exiting the ventilation slots. The exhaust arc gas manifold is fixedly attached to the circuit breaker and includes: an electrically-insulated body having an upper wall and a lower wall joined by a back wall extending generally perpendicular to the upper and lower walls; a pair of electrically-insulated walls extending generally perpendicular from the back wall between the upper and lower walls defining a first section, a second section, and a third section; the first section is closed at a bottom, back and both sides thereof; the second section is closed at a top, bottom and both sides thereof; the third section closed at a bottom, back and both sides thereof; and the upper wall configured to attach the electrically-insulated body to one end of the circuit breaker, wherein exhaust arc gas is emitted from a top of the first and third sections and from a back of said second section.

14 Claims, 6 Drawing Sheets

EXHAUST ARC GAS MANIFOLD

BACKGROUND OF THE INVENTION

Circuit breakers are commonly mounted within an electrical enclosure or draw out unit to provide overcurrent protection to a circuit. A line side of the circuit breaker is connected to an electrical power line supplying electricity and a load side of the circuit breaker is connected to the circuit to be protected. In all circuit breakers, the separation of the breaker contacts due to a short circuit causes an electrical arc to form between the separating contacts. The arc causes the formation of relatively high-pressure gases as well as ionization of air molecules within the circuit breaker. These high-pressure gases can cause damage to the breaker casing. The gases, therefore, must be vented from the circuit breaker enclosure. In addition, a phase-to-phase fault can occur if the arc gases from different phases are allowed to mix, and a phase-to-ground fault can occur if the gases contact the grounded enclosure. To avoid a phase-to-phase or phase-to-ground fault, gases vented from different phases must be kept separate from each other and away from the grounded enclosure until the ionization has dissipated. These high temperature gases must exit the circuit breaker enclosure in order to prevent the circuit breaker enclosure from becoming over-stressed. Ventilated circuit breakers provide openings within the circuit breaker enclosure to allow the ionized gases to exit the circuit breaker in a controlled manner.

U.S. Pat. No. 5,241,289, entitled "Exhaust Arc Gas Manifold" describes one means for controlling the egress of gases from a three phase circuit breaker enclosure. The arc gases exiting through the ventilation slot of one line terminal compartment must be prevented from contacting a line terminal connector within an adjacent line terminal compartment to prevent a so-called "phase-to-phase" fault. The approach disclosed in U.S. Pat. No. 5,241,289 to prevent the occurrence of short circuits between the line end conductors of different phases utilizes a manifold disposed at the line end conductors. The manifold channels the center phase exhaust arc gas directly outward and channels the phases on either side of the center phase generally perpendicular to the center exhaust arc gas direction and in opposite directions to each other. This practice works well when space is abundant surrounding the circuit breaker to allow egress of the exhaust arc gas from the circuit breaker.

However, modern circuit breaker designs are becoming more compact and are required to handle additional power in smaller enclosures than conventional circuit breakers. Due to the reduction of internal space and higher current levels, the gases produced when opening the circuit in question are more intense and at higher temperatures. Furthermore, as space surrounding the circuit breaker is reduced, the likelihood of phase-to-phase and phase-to-ground arcing is increased. Thus, an apparatus is needed to provide protection from short circuits for interruption circuit breakers during the interrupt condition utilized in smaller electrical enclosures to divert exhaust arc gases in a manner that does not cause phase-to-phase and phase-to-ground arcing. Furthermore, an apparatus that provides protection that can be field installed as an add-on feature to any type of circuit breaker is needed.

SUMMARY OF INVENTION

The above discussed and other drawbacks and deficiencies are overcome or alleviated by an exhaust arc gas manifold attachable to a circuit breaker, the manifold comprising: an electrically-insulated body having an upper wall and a lower wall joined by a back wall extending generally perpendicular to the upper and lower walls; a pair of electrically-insulated walls extending generally perpendicular from the back wall between the upper and lower walls defining a first section, a second section, and a third section; the first section is closed at a bottom, back and both sides thereof; the second section is closed at a top, bottom and both sides thereof; the third section closed at a bottom, back and both sides thereof; and the upper wall configured to attach the electrically-insulated body to one end of the circuit breaker, wherein exhaust arc gas is emitted from a top of the first and third sections and from a back of said second section.

BRIEF DESCRIPTION OF DRAWINGS

Referring now to the drawings wherein like elements are numbered alike in the several Figures.

DETAILED DESCRIPTION

Figure 1:
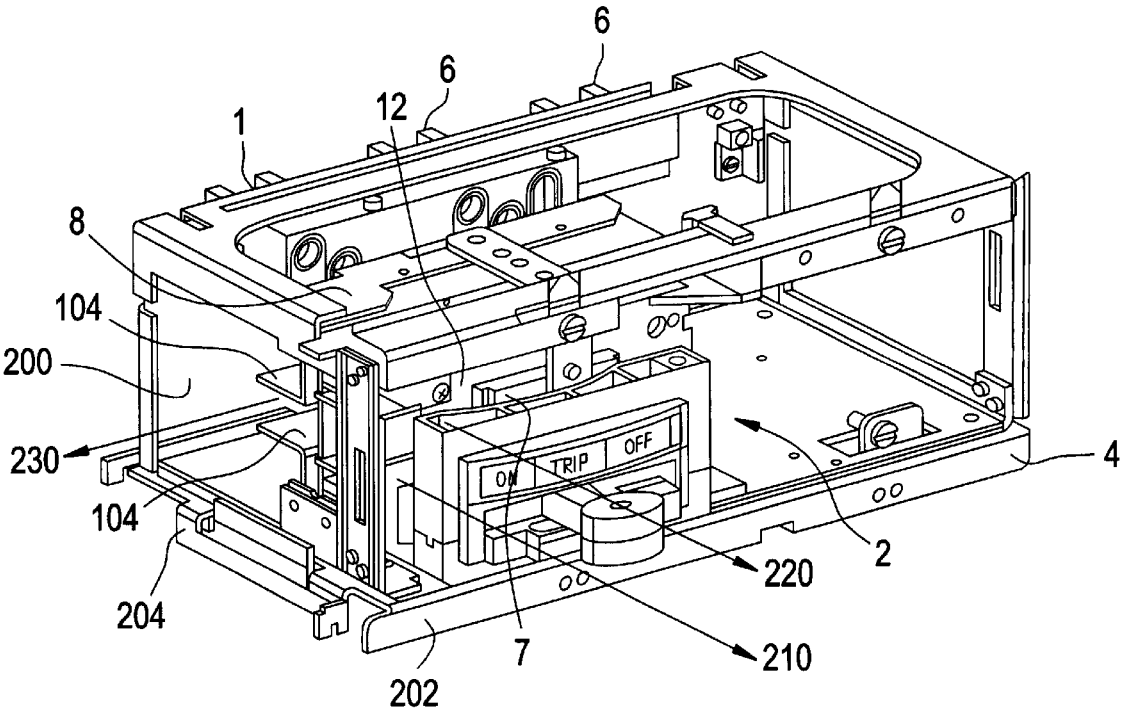
FIG. 1 is a perspective view of a draw out unit having a circuit breaker assembly including a handle operator mechanism installed therein.

FIG. 1 illustrates a circuit breaker assembly 2 mounted within an electrical enclosure (draw out unit) 4 for a motor control center. Enclosure 4 is, in turn, inserted into an opening within a motor control center cabinet (not shown). Extending from the back of enclosure 4 is a plurality of bus stabs or clips 6. Bus stabs 6 make an electrical connection with a plurality of bus bars (not shown) as enclosure 4 is slid into the opening in the motor control center cabinet. Bus stabs 6 are electrically connected to a circuit breaker 12 within the circuit breaker assembly 2. A handle operator mechanism 8 encases circuit breaker 12. Handle operator mechanism 8 captures an operating handle 7 of the circuit breaker 12 to switchably operate circuit breaker 12.

Figure 2:
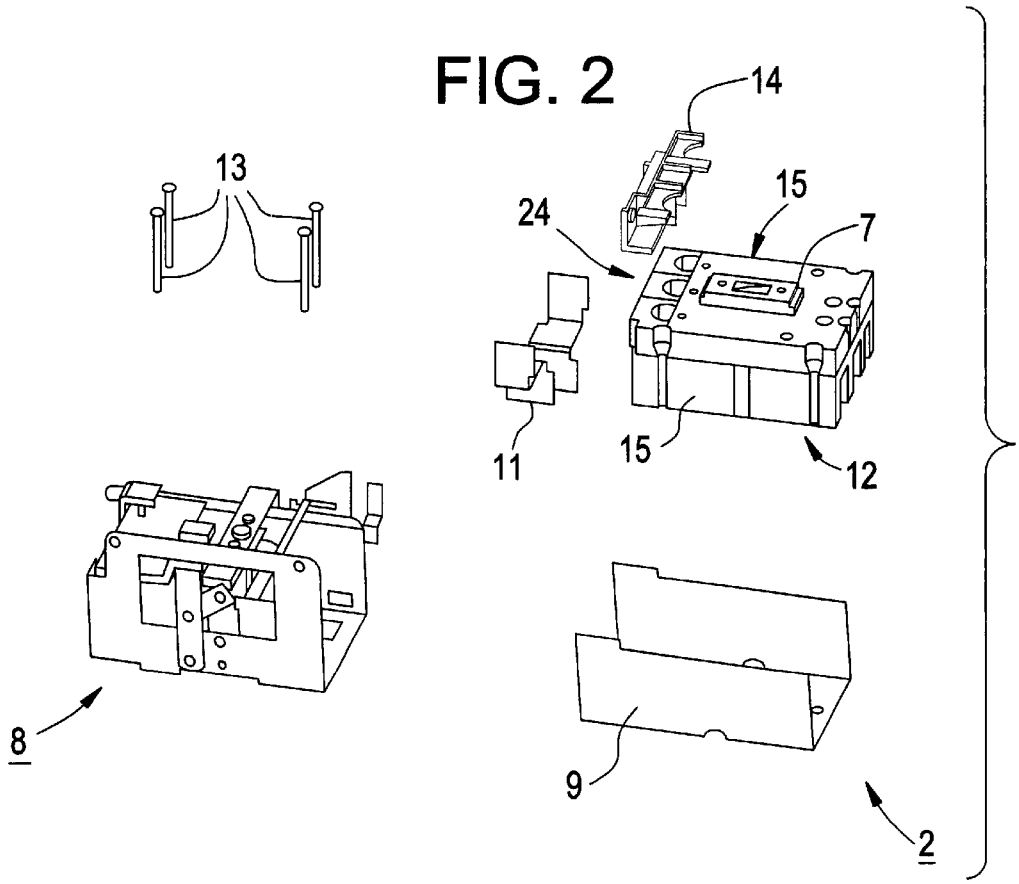
FIG. 2 is an exploded view of the circuit breaker assembly in FIG. 1.

FIG. 2 is an exploded view of circuit breaker assembly 2 in FIG. 1. Circuit breaker assembly 2 comprises circuit breaker 12 having exhaust arc manifold 14 disposed proximate line side terminals to divert arc gases from circuit breaker 12. Exhaust arc gas manifold 14 further includes a barrier 11 depending from a line end 24 of circuit breaker 12 preventing any gases from flowing from the sides of manifold 14. Fiber paper insulation 9 is disposed around two side walls 15 and lines the bottom of circuit breaker 12 to isolate exhaust arc gas surrounding metallic handle operator mechanism 8. Circuit breaker 12 is mounted to enclosure 4 via handle operator mechanism 8 using four screws 13.

Figure 3:
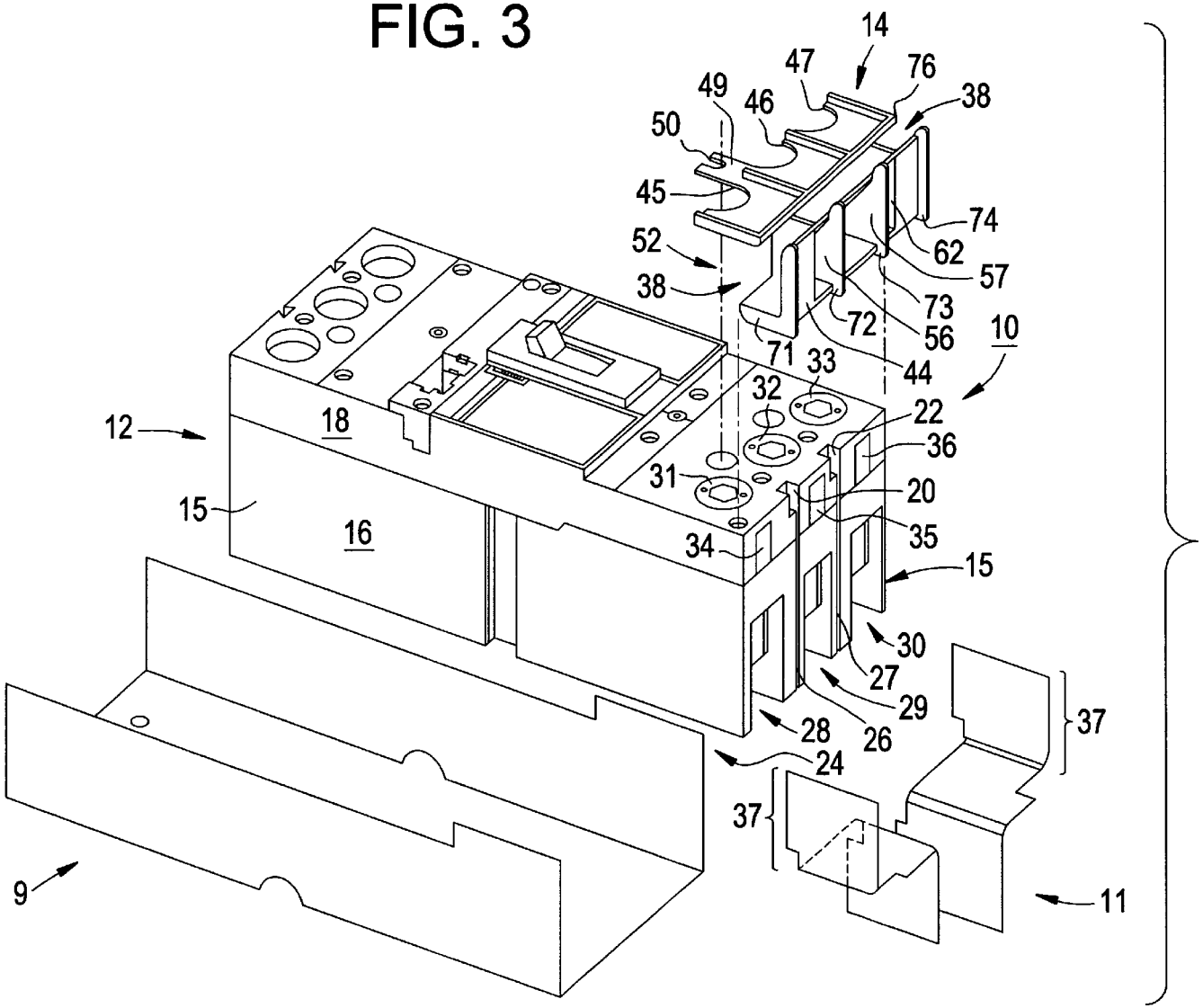
FIG. 3 is an exploded top perspective view of a circuit breaker with an exhaust arc gas manifold in FIG. 2.

FIG. 3 depicts a subassembly 10 of circuit breaker assembly 2, including industrial rated multiphase circuit breaker 12 and exhaust arc manifold 14. Circuit breaker 12 consists of a molded plastic case 16 and molded plastic cover 18. Circuit breaker 12 further includes dovetail notches 20, 22 disposed within cover 18 at line end 24 of circuit breaker 12 and elongated slots 26, 27 formed within cover 18 and extending downward from dovetail notches 20, 22 through case 16. Dovetail notches 20, 22 and elongated slots 26, 27 are positioned between phases 28–30 of circuit breaker 12. Line connection plugs 31–33 are disposed on a top surface of cover 18 to allow access to terminal screws (not shown). Ventilation slots 34–36 are formed at each phase 28–30 of circuit breaker 12 to vent ionized gases generated from within each phase 28–30 during circuit breaker interrupt conditions. Exhaust arc manifold 14 includes barrier 11 having an upper portion 37 that prevents ionized gases generated in phases 28 and 30 from venting out sides 38 of manifold 14 and includes a lower portion that isolated gases generated in phase 29.

Figure 4:
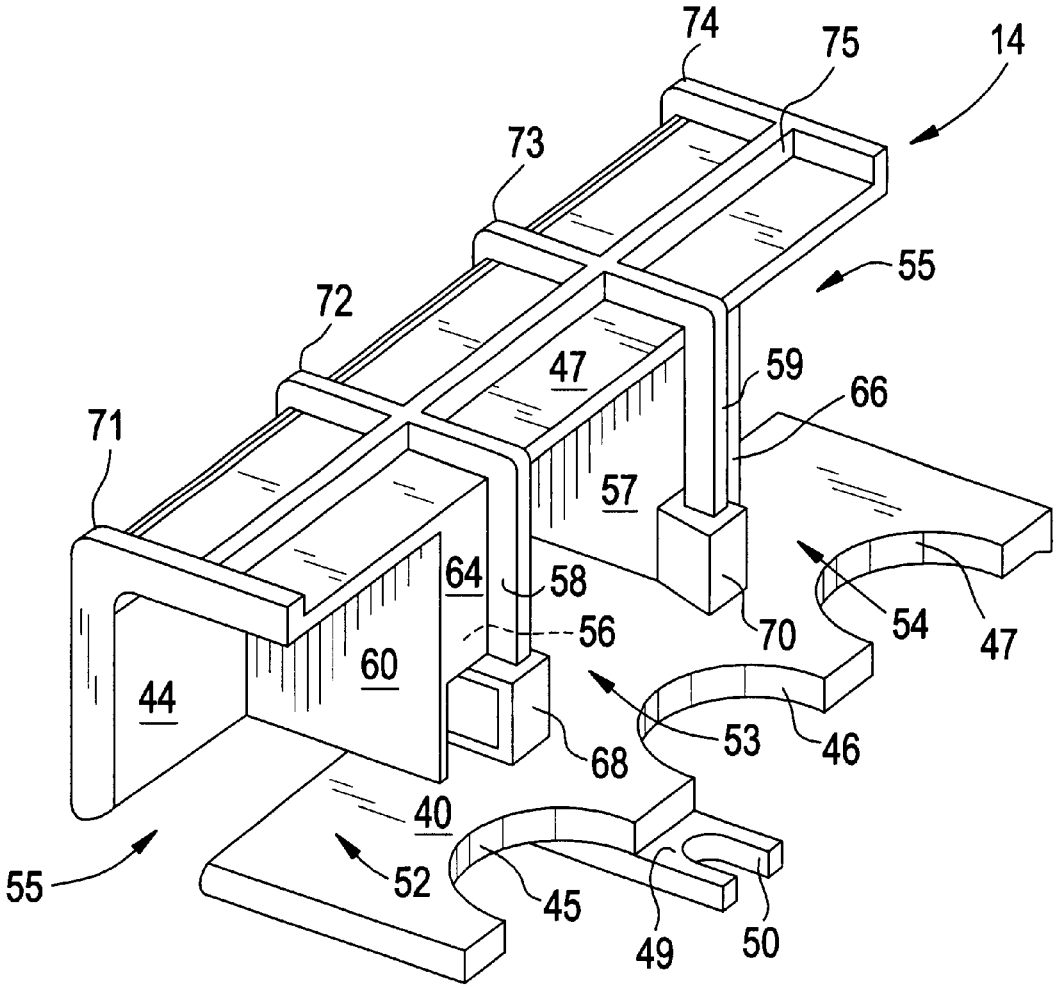
FIG. 4 is an upside down perspective view of the exhaust arc gas manifold of FIG. 3.
Figure 5:
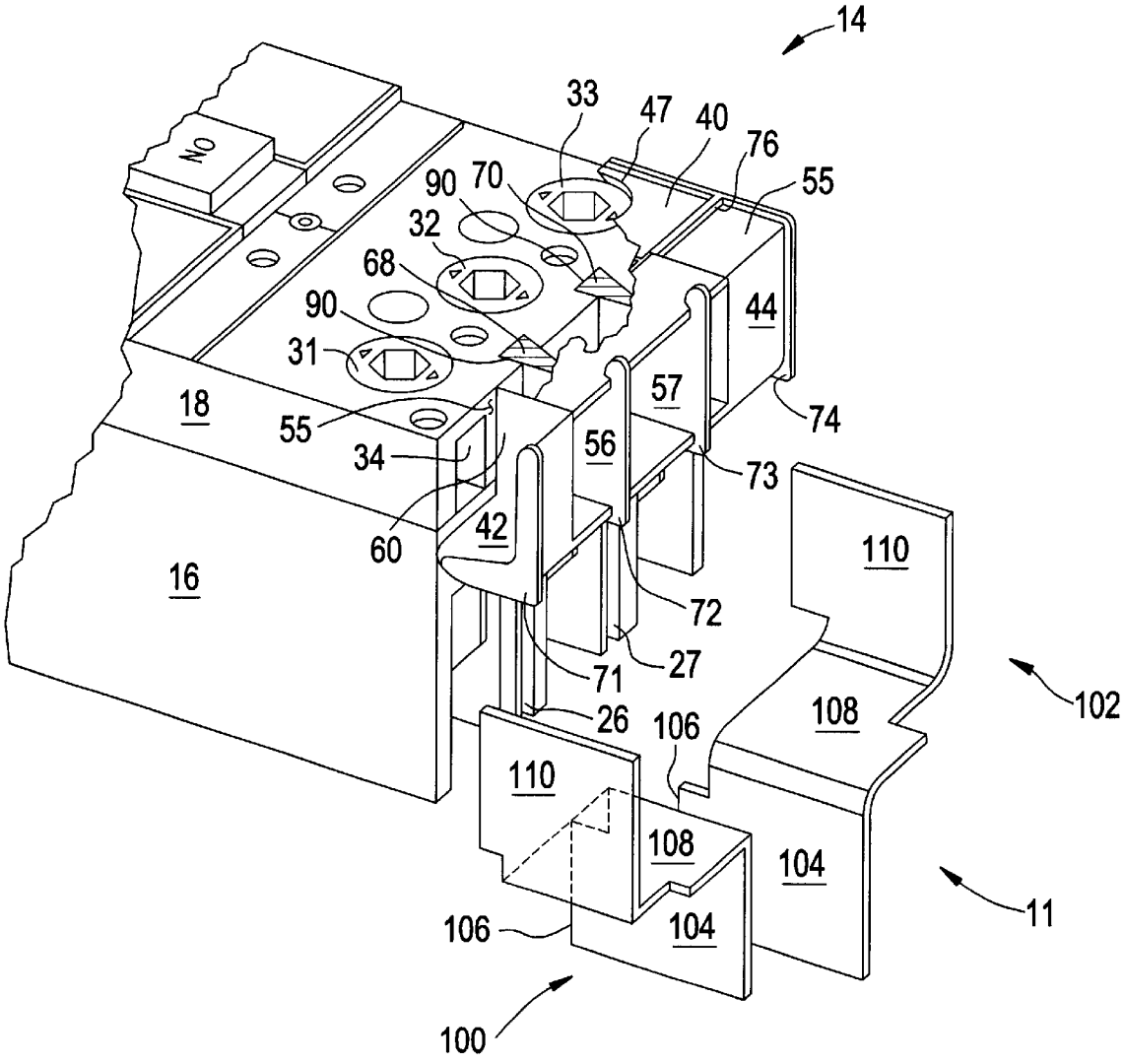
FIG. 5 is a top perspective cut-away view of the circuit breaker and the exhaust arc gas manifold of FIG. 3.

Referring now to FIG. 4, manifold 14 comprises an integrally molded one piece body having generally a C-shape that is formed by an upper wall 40, a lower wall 42, and a back wall 44 extending between upper wall 40 and lower wall 42, wherein an open end of upper wall 40 extends further outward than that of the lower wall 42. Upper wall 40 includes radial notches 45–47 disposed on the open end thereof to allow access to the corresponding line connection plugs 31–33 of circuit breaker 12, as shown in FIG. 5. Upper wall 40 also includes a protruding arm 49 disposed between two of radial notches 45, 46 and having a radial slot 50 at the end thereof. Manifold 14 is subdivided into three sections, two outer sections 52, 54 and one central section 53, by means of two partition walls 56, 57. Each section 52–54 corresponds to each phase 28–30 of circuit breaker 12. Partition walls 56, 57 extend between upper wall 40 and lower wall 42, so that the three sections 52–54 are wholly isolated from one another. Partition walls 56, 57 extend further outward than lower wall 42, forming flanges 58, 59. Back wall 44 connects upper wall 40 and lower wall 42 in central section 53 proximate joining of partition walls 56, 57. Back wall 44 produces an opening in the center section 53 to allow the exhaust arc gases to vent. An opening 55 is formed in outer sections 52 and 54 of upper wall 40 to allow exhaust gases to vent from sections 52 and 54.

Outer sections 52,54 include a tapered wall 60, 62 adjacent to partition walls 56, 57 and a web 64, 66 connecting tapered walls 60, 62 to the respective partition walls 56, 57. Web 64, 66 is perpendicular to partition wall 56, 57 and forms an obtuse angle with tapered wall 60, 62. Tapered wall 60, 62 extends between upper wall 40 and lower wall 42 of manifold 14 and connects with back wall 44. Web 64, 66 and partition wall 56, 57 are notched out at the connection with upper wall 40 to accommodate a dovetail 68,70. Dovetails 68, 70 protrude past partition walls 56, 57 and rest on upper wall 40 which also protrudes past partition wall 56, 57 and still further than dovetails 68, 70.

Stiffening ribs 71–74 disposed on the outside of the C-shaped manifold 14 follow the general shape thereof and provide additional strength thereto. Perpendicular strengthening ribs 75,76 disposed on upper wall 40 and lower wall 42 of manifold 14 extend substantially across upper wall 40 and lower wall 42 of manifold 14. Manifold 14 is formed from a molded thermoplastic material.

Referring to FIG. 5, a description of barrier 11 is detailed below. Barrier 11 comprises a pair of phenolic barriers 100, 102. Although a phenolic barrier is specified, other materials that are capable of blocking arc gases from circuit breaker 12 are contemplated. Each phenolic barrier 100, 102 includes a first surface plane 104 having an edge 106 configured to be receivably retained in slots 26, 27 of circuit breaker 12. A second surface plane 108 extends generally perpendicularly from another edge of first surface plane 104 extending to ribs 71 and 74. A third surface plane 110 extends from an edge of second surface plane 108 proximate ribs 71, 74 generally perpendicular to second surface plane 108. Third surface plane 110 is configured to cover sections 52 and 54 of manifold 14, thus preventing gas from emanating from sides 38 of manifold 14 when barrier 11 is installed on circuit breaker 12.

Figure 6:
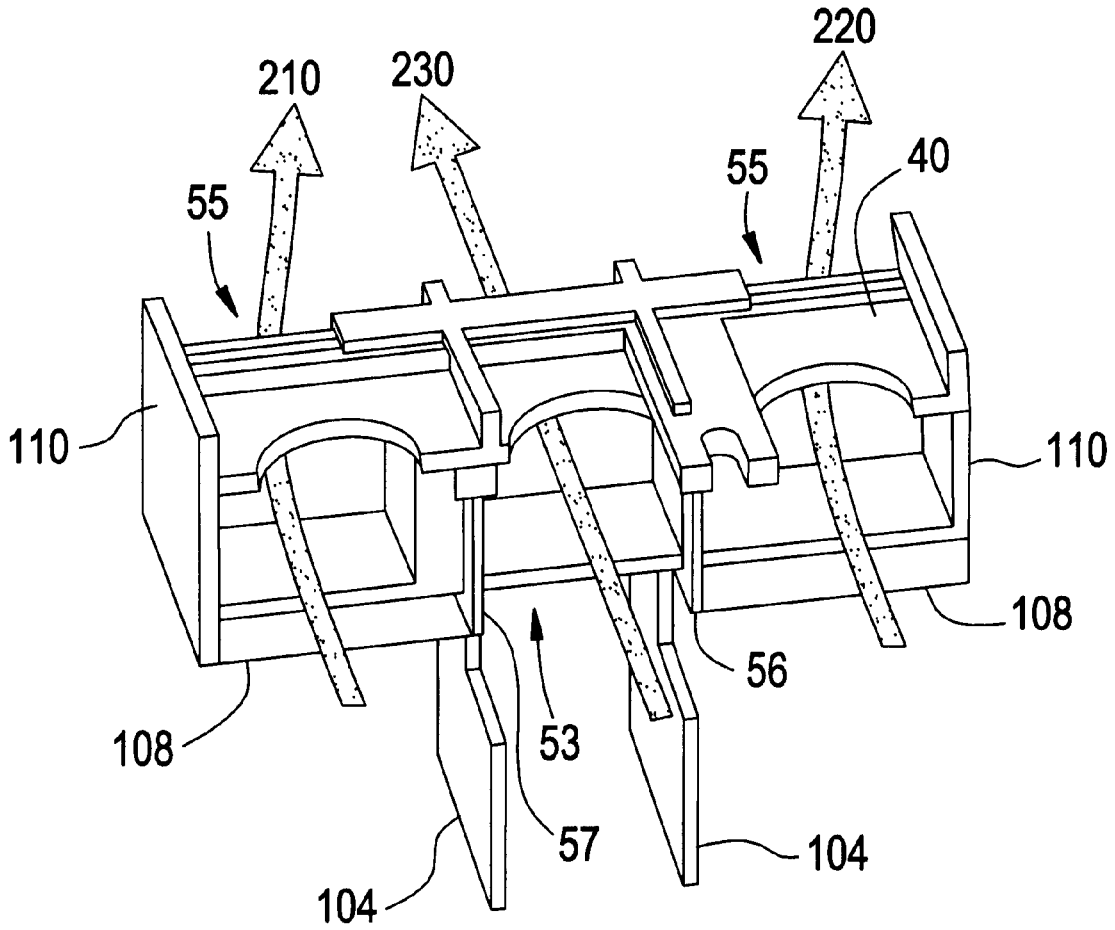
FIG. 6 is a top perspective view of the exhaust arc gas manifold and barrier in FIG. 2 detailing gas flow for each phase.

In operation, as shown in FIGS. 3, 5 and 6, manifold 14 is oriented so that upper wall 40 is in the upper position and flanges 58, 59 of partition walls 56, 57 engage dovetail notches 20, 22 of circuit breaker 12 and slide further down into notches 26, 27 of circuit breaker 12. Dovetails 68, 70 of manifold 14 engage circuit breaker 12 dovetail notches 20, 22, forming dovetail joints 190 (FIG. 5), and fixedly securing manifold 14 to circuit breaker 12 so that the force of the gases exiting circuit breaker 12 does not pull manifold 14 away. Dovetail joints 190 provide a locking mechanism sufficient to withstand the force of the outpouring exhaust gases from ventilation slots 34–36 of circuit breaker 12.

As dovetail joints 190 are formed, upper wall 40 rests on circuit breaker cover 18. Radial slot 50 formed within arm 49 can be used to fasten manifold 14 to circuit breaker 12 by means, such as screws. As gases exit circuit breaker 12 through ventilation slots 34–36, manifold 14 redirects the gases in such a way that center phase 35 gases enter central section 53 of manifold 14 and exit straight through. The gases exiting from outer phases 34, 36 enter outer sections 52, 54 of manifold 14 and are diverted at generally a 90 degree angle and exit through openings 55 of manifold 14 opposite bus stab 6 terminal connections, thereby avoiding intermixing with gases in the other sections and contacting line and bus stab terminal conductors, until the gases are cooled and de-ionized, thus causing effective redirection of exhaust gases.

Referring to FIG. 6, it can be seen that central section 53 is further isolated with first surface plane 104 aligned with each partition wall 56, 57. In this manner, arc gases from ventilation slot 35 are isolated from gases emitted from ventilation slots 34, 36 and vice versa, thus limiting phase-to-phase faults. More specifically, as best seen referring to FIGS. 1 and 6, arc gases from central section 53 are directed toward a side of a motor control cabinet surrounding enclosure 4. As arc gases from central section 53 are directed toward the side of the motor control cabinet (not shown), a surface forming an inside of motor control cabinet blocks further travel of gas from central section in that direction. First surface plane 104 further directs the arc gasses from central section 53 to open space within a rear portion of enclosure 4. Arc gases emitted from outer section 54,52 are directed toward a front facing plane 202 of enclosure 4 in directions depicted with arrows 210, 220, respectively. Arc gas emitted from central section 53 is directed to a plane 204 of enclosure 4 that is adjacent and generally perpendicular to the front facing plane 202 (as shown in FIG. 1) and in a direction depicted with arrow 230. FIG. 1 shows an arc gas direction from central section 53 when enclosure 4 is removed from a motor control cabinet (not shown). It will be appreciated that when enclosure 4 is installed in a motor control cabinet, arc gases emitted from central section 53 are directed to open space 200 within enclosure 4.

Figure 7:
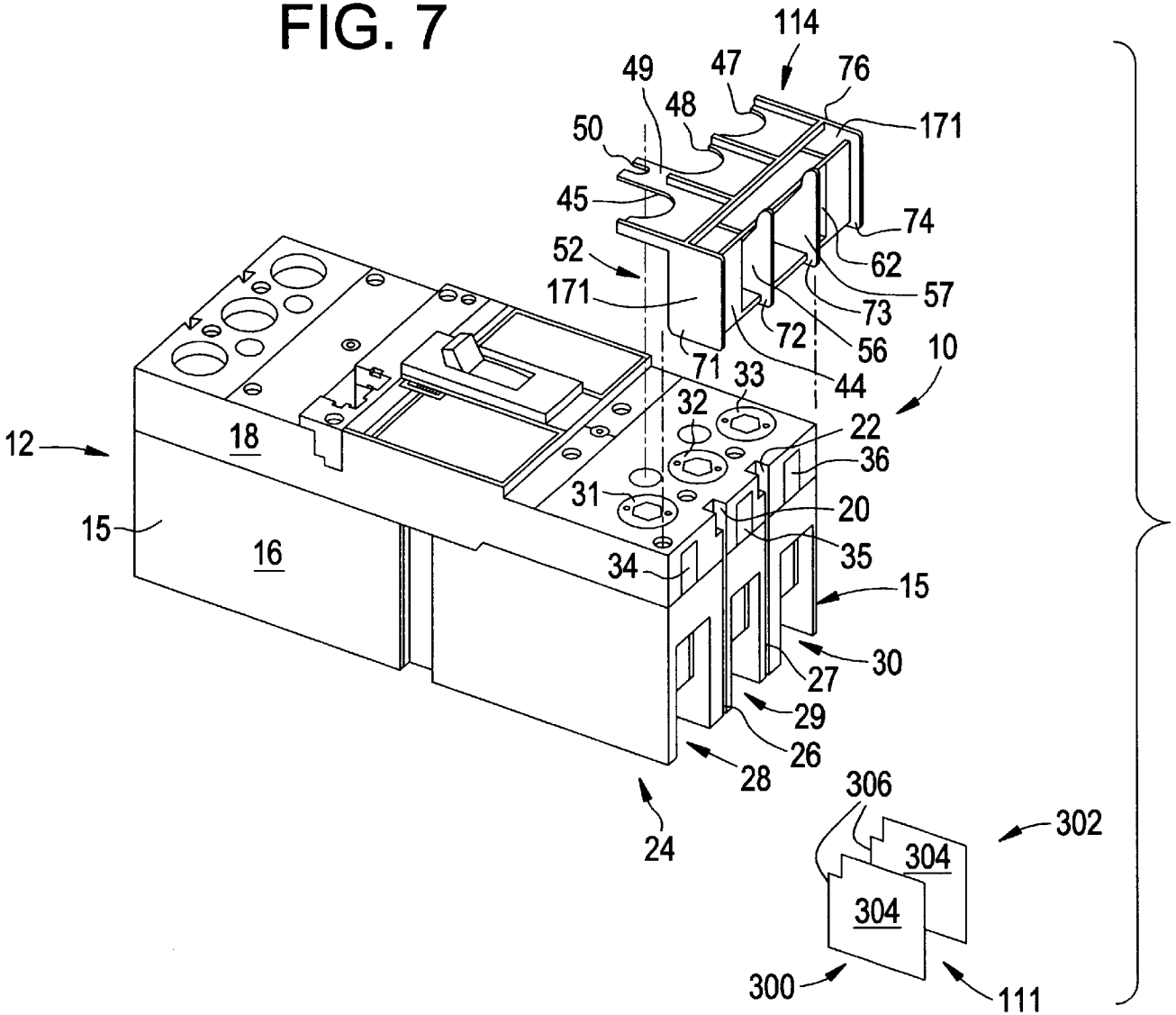
FIG. 7 is an exploded top perspective view of a circuit breaker with an alternative exemplary embodiment of the exhaust arc gas manifold in FIG. 3.

Referring to FIG. 7, an alternative exemplary embodiment of manifold 114 and barrier 111 is shown. Stiffening ribs 71, 74 on either side of manifold 114 extend to form sides 171, 174, thus closing the sides of manifold 14. It will be noted that sides 171, 174 are substituted for third surface planes 110 on barrier 11 to cover sections 52 and 54 of manifold 114, thus preventing gas from emanating from sides 38 (see FIG. 3) of manifold 14 when installed on circuit breaker 12. Barrier 111 comprises a pair of phenolic barriers 300, 302. Although a phenolic barrier is specified, other materials that are capable of blocking arc gases from circuit breaker 12 are contemplated. Each phenolic barrier 300, 302 includes a first surface plane 304 having an edge 306 configured to be receivably retained in slots 26, 27 of circuit breaker 12. First surface plane 304 further directs the arc gasses from central section 53 to open space within a rear portion of enclosure 4.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An exhaust arc gas manifold for a circuit breaker comprising:

an electrically-insulated body having an upper wall and a lower wall joined by a back wall extending substantially perpendicular to said upper wall and said lower wall;

a pair of electrically-insulated walls extending substantially perpendicular from said back wall between said upper and lower walls defining a first section, a second section, and a third section;

said first section is closed at a bottom, back and both sides thereof;

said second section is closed at a top, bottom and both sides thereof;

said third section closed at a bottom, back and both sides thereof; and said upper wall configured to attach said electrically-insulated body to one end of the circuit breaker, wherein exhaust arc gas is emitted from a top of said first section and said third section and from a back of said second section.

2. The gas manifold of claim 1 wherein a bottom surface of said upper wall is configured for being received in slots formed in a circuit breaker cover to hold said manifold against one end of the circuit breaker.

3. The gas manifold of claim 2 wherein said manifold further comprises:

an insulative barrier including a third plane aligned and extending from each of said pair of electrically-insulated walls to further isolate said second section.

4. The gas manifold of claim 3 wherein an edge of each said third plane is configured for being received in said slots formed in the circuit breaker cover to hold said manifold against said one end of the circuit breaker.

5. An exhaust arc gas manifold for a circuit breaker comprising:

an electrically-insulated body having an upper wall and a lower wall joined by a back wall extending substantially perpendicular to said upper wall and said lower wall;

a pair of electrically-insulated walls extending substantially perpendicular from said back wall between said upper and lower walls defining a first section, a second section, and a third section;

said first section is closed at a bottom, back and one side thereof; said second section is closed at a top, bottom and both sides thereof;

said third section closed at a bottom, back and one side thereof;

an insulative barrier disposed at each other side of said first section and said third section, wherein exhaust arc gas is emitted from a top of said first section and said third section; and said upper wall configured to attach said electrically-insulated body to one end of the circuit breaker.

6. The gas manifold of claim 5 wherein said upper wall, lower wall and back wall are integrally formed in a single unit.

7. The gas manifold of claim 5 wherein said electrically insulated body is constructed of plastic.

8. The gas manifold of claim 5 wherein said upper wall includes radial slots allowing access to circuit breaker terminal lugs when said manifold is attached to one end of the circuit breaker.

9. The gas manifold of claim 5 wherein a bottom surface of said upper wall is configured for being received in slots formed in a circuit breaker cover to hold said manifold against one end of the circuit breaker.

10. The gas manifold of claim 9 wherein said bottom surface includes a pair of dovetail extensions.

11. The gas manifold of claim 9 wherein said insulative barrier includes a first plane disposed at said each other side of said first section and said third section, a second plane extending substantially perpendicular from each said first plane extending toward said second section, and a third plane extending substantially perpendicular from each said second plane aligned with each of said pair of electrically-insulated walls to further isolate said second section.

12. The gas manifold of claim 11 wherein an edge of each said third plane is configured for being received in said slots formed in the circuit breaker cover to hold said manifold against said one end of the circuit breaker.

13. The gas manifold of claim 5 including an arm extending from said upper wall, said arm configured at one end for receiving a threaded fastener to secure said manifold to the circuit breaker.

14. The gas manifold of claim 5 wherein said insulative barrier is a phenolic barrier.

* * * * *